United States Patent [19]

Rotondi et al.

[11] 4,397,168

[45] Aug. 9, 1983

[54] DOOR REINFORCEMENT AND LOCK GUARD PLATE

[75] Inventors: Anthony J. Rotondi, Whittier; Richard O. Mullich, Burbank, both of Calif.

[73] Assignee: TRE Corporation, Beverly Hills, Calif.

[21] Appl. No.: 379,302

[22] Filed: May 18, 1982

Related U.S. Application Data

[63] Continuation of Ser. No. 141,417, Apr. 18, 1980, abandoned.

[51] Int. Cl.[3] ..... E05B 15/02

[52] U.S. Cl. ..... 70/417; 70/452

[58] Field of Search ..... 70/417, 448, 450, 451, 70/452; 292/337, 346, 357

[56] References Cited

U.S. PATENT DOCUMENTS

| | | | |
|---|---|---|---|
| 631,431 | 8/1899 | Phelps | 70/452 |
| 940,261 | 11/1909 | Magruder | 70/452 |
| 4,129,020 | 12/1978 | Gonzalez | 70/452 |

*Primary Examiner*—Robert L. Wolfe

*Attorney, Agent, or Firm*—Spensley, Horn, Jubas & Lubitz

[57] ABSTRACT

An L-shaped guard plate for reinforcing a door in the area of the door lock assembly. The L-shape provides a strengthening function without introducing any misalignment in the position of the lock bolt of a door with respect to the strike plate carried in a door frame. The device is thus both effective and easily installed on most doors. The guard plate may include integral tabs which engage slots in the housing of the lock unit. The tabs serve to provide increased resistance to the application of rotational forces to the lock unit.

6 Claims, 6 Drawing Figures

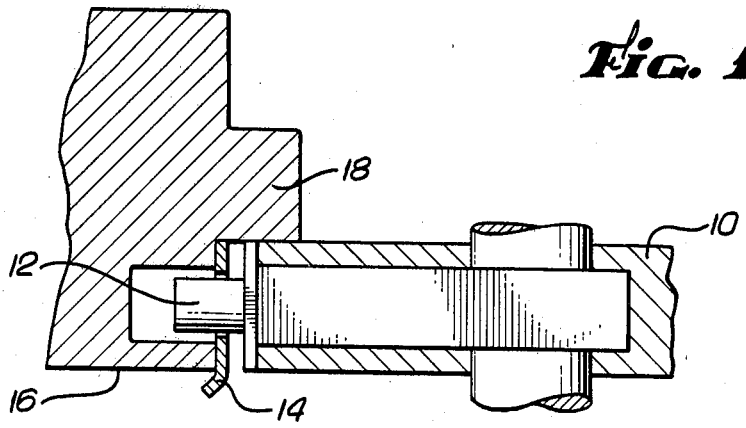
FIG. 1.
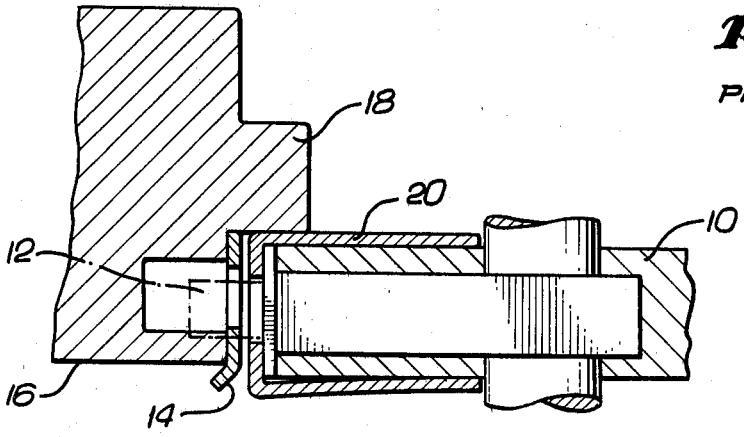
FIG. 2.
PRIOR ART
FIG. 3.
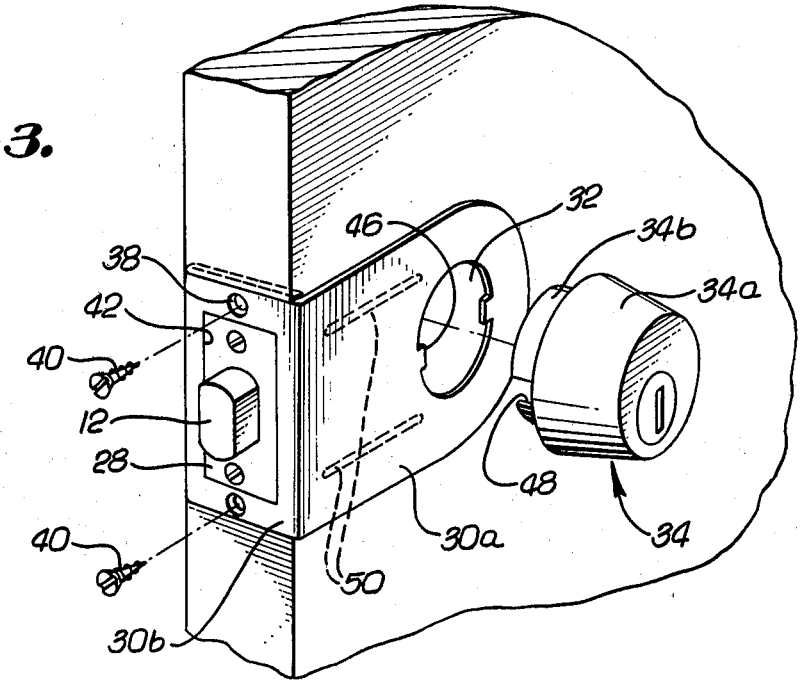

DOOR REINFORCEMENT AND LOCK GUARD PLATE

This is a continuation of application Ser. No. 141,417, filed Apr. 18, 1980 and now abandoned.

BACKGROUND OF THE INVENTION

1. Field of the Invention

This invention relates to guard plates which fit over a door in the area where the lock is mounted in order to increase the horizontal impact resistance of the door.

2. Description of the Prior Art

It is known in the art to provide a U-shaped plate which surrounds the edge of a door and which has openings through which the inside and outside doorknobs and/or a deadbolt unit extend. These U-shaped plates may be provided for either decorative or security purposes. Plates of this type are disclosed in U.S. Pat. Nos. 950,926 to Keil, 3,666,309 Zarzycki, 3,673,605 to Allenbaugh, 4,139,999 to Allenbaugh and 4,141,234 to Hoos.

By utilizing guard plates of the above described type, doors which normally have relatively low security with respect to retaining a lock within the door, such as hollow pine doors, can in effect be strengthened so that the lock mounted in such doors can withstand relatively high horizontal impact forces. These U-shaped guard plates are thus useful both in reducing the cost of doors which must meet particular strength standards and also for increasing the horizontal impact resistance (e.g., resistance to kicking or shoulder impact) of existing doors in the area of the lockset.

One problem with the use of the above described U-shaped guard plates with existing doors (i.e., as an aftermarket device) is the possibility that their installation will cause misalignment between the lock bolt of the door and the striker plate located on the door frame and through which the lock bolt extends. In many instances, the initial installation of a door is such that when it is closed, it will rest against a door stop, as shown in FIG. 1 of the drawings. The installation of a U-shaped guard plate causes the closed position of the door to move slightly away from the doorstop, which may in turn prevent the lock bolt from properly fitting into the opening in the strike plate carried in the door frame. This situation is illustrated in drawing FIG. 2. Therefore, the use of a U-shaped guard plate is not always possible unless the strike plate and the opening beneath it are repositioned.

The primary object of the present invention is to provide a guard plate which strengthens a door in the area of the lock assembly and does not present any problems with respect to misalignment of the lock bolt caused by installation of the guard plate.

Another object of the present invention is to provide a guard plate which enables softwood doors to meet strength standards which normally can be met with only metal or hardwood.

A further object of the invention is to provide a guard plate which is configured to resist forced rotation of a deadbolt lock to thereby improve the security of such a lock.

SUMMARY OF THE INVENTION

The present invention achieves the above objectives by providing an L-shaped guard plate having one leg which extends over the face of the door in the direction which the door opens and a second leg which extends over the edge of the door and includes an opening through which the lock bolt assembly extends. The first leg includes an opening through which a deadbolt lock unit and/or door knob extends. The L-shaped arrangement provides most of the strengthening which would be provided by a typical U-shaped guard plate. However, since the guard plate does not extend over the face of the door which contacts the door stop, no misalignment problem is presented. The L-shaped guard plate therefore has a more universal application than prior art guard plates. Further, by utilizing integral lugs on the plate with mating slots or recesses in a deadbolt housing, forced rotation of the deadbolt lock unit is prevented, thereby further increasing lock security.

BRIEF DESCRIPTION OF THE DRAWINGS

In the drawings

FIG. 1 is a top plan view showing a door lock arrangement without any type of strengthening device;

FIG. 2 is top plan view showing the alignment problems presented with a prior art U-shaped guard plate;

FIG. 3 is a perspective view of the L-shaped guard plate of the present invention;

DESCRIPTION OF THE PREFERRED EMBODIMENT

Figure 4:
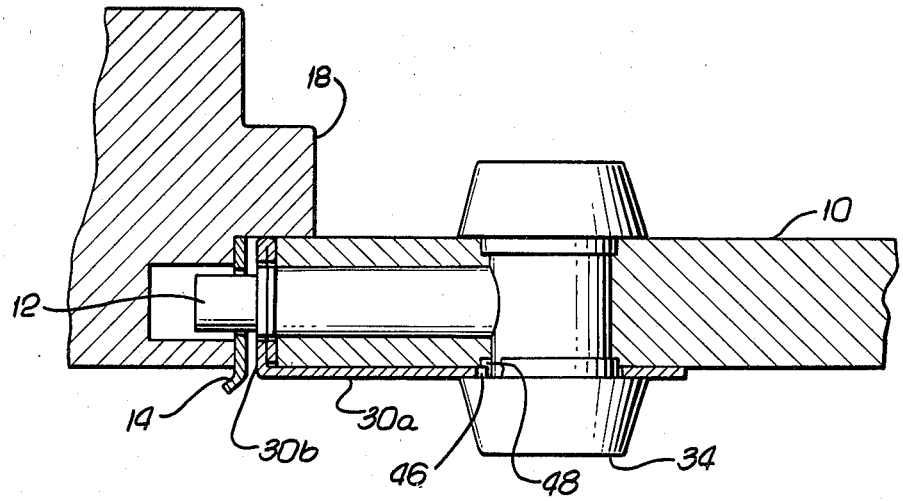
FIG. 4 is a top plan view of the L-shaped guard plate of the present invention.

Referring to FIG. 1, a door 10 without any type of strengthening device is shown in a closed position. In this position a lock bolt 12 extends from the door 10 through an opening in a strike plate 14 which is located on a door frame 16. One face of the door 10 rests against a door stop 18 which is part of the frame 16.

As shown in FIG. 2, the addition of a U-shaped guard plate 20 can cause misalignment between the lock bolt 12 and the strike plate 14. This misalignment is caused by the fact that a leg of the U-shaped plate 20 is now in contact with the door stop 18, which causes the closed position of the door 10 to be moved with respect to its closed position without the guard plate. The present invention is designed to overcome this misalignment problem.

Referring now to FIGS. 3 and 4, the present invention comprises an L-shaped metal (such as steel aluminum,zinc or brass) guard plate 30 having a first leg **30*a* which extends over the face of the door which is opposite the doorstop 18, and a second leg 30*b* which fits over the edge of the door 10. The leg 30*a* of the guard plate includes an opening 32 through a deadbolt lock unit 34 extends. The lock unit 34 includes (along with other components) a cover plate 34*a* covering a housing having a cylindrical flange 34*b*. A pair of holes 38 are included on the leg 30*b* and a pair of screws 40 pass through the holes 38 to secure the guard plate 30 flush with the door edge 10*b*. A generally rectangular opening 42 is provided for the existing lock bolt faceplate 28 through which a lock bolt 12** extends.

As shown in FIG. 4, the installation of the guard plate 30 will not cause any misalignment of the lock bolt 12 with respect to the strike plate 14. If the door 10 is of a type which opens to the inside, the plate 30 is positioned so that the leg 30*a* is on the inside face of the door 10. However, if the door 10 opens to the outside, the plate 30 is positioned so that the leg 30*a* is located on the outside face of the door. Thus, installation of the guard plate 30 is always done so that the plate does not contact the doorstop 18, in order to eliminate any potential misalignment problems.

In order to provide resistance to the application of rotational force to the lock unit 34, one or more integral tabs 46 (FIG. 3) may be included around the perimeter of the opening 32. The tabs 46 intermember with slots 48 in the flange 34*b*, so that in order to rotate the lock unit 34 and retract the lock bolt 12, the shear strength of the tabs 46 must be overcome. Rotation of the lock unit 34 is one of the most common forms of forced entry, so the increased resistance to such rotation can be extremely beneficial. Horizontal reinforcing ribs 50 may be included to further increase the bending resistance of the plate 30, further increasing resistance to horizontal impact forces, including those applied to the opposite side of the door.

Figure 5:
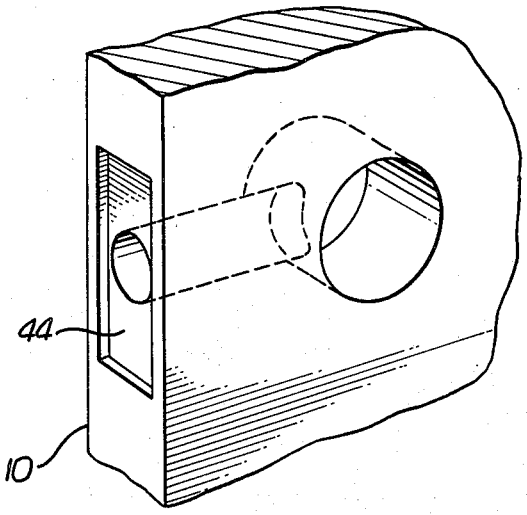
FIG. 5 is a perspective view of a conventional mortise of a door edge.

As shown in FIG. 5, conventional lock systems utilize a door edge having a mortise 44 to hold a lock bolt faceplate which requires a skillful cut to be made in the edge of door 10. The guard plate 30 of the present invention, however, can be used with a routed door edge (i.e., a cut across the entire width of the edge) which is much simpler to form than a conventional mortise. The door edge is routed so that the leg 30*b* of the guard plate fits substantially flush with the edge of the door.

Figure 6:
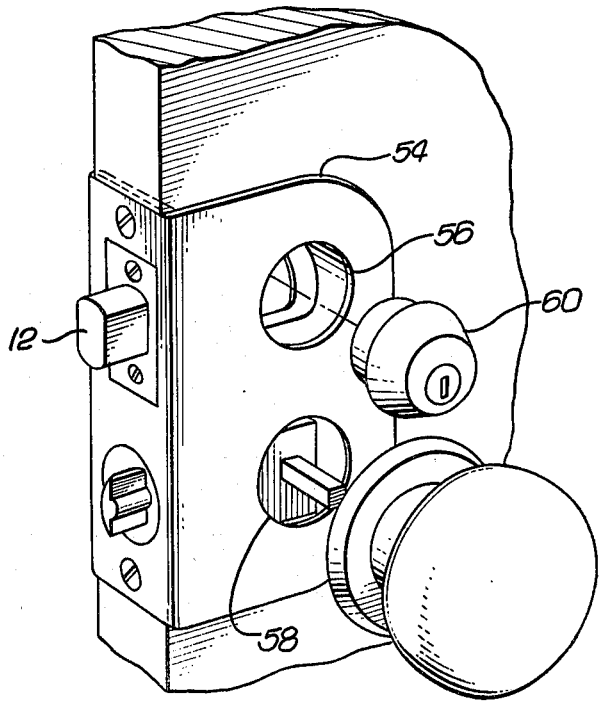
FIG. 6 is a perspective view of an L-shaped guard plate for use with a combination knob and deadbolt assembly.

In summary, the present invention provides a guard plate which reinforces a door against horizontal impact in the area of the deadbolt lock assembly and yet eliminates misalignment problems caused by prior art reinforcing devices. In addition, the invention provides increased resistance to the application of rotational or torsional forces to the lock unit. The addition of the guard plate of the present invention thus increases the security of a door against the two most common types of tampering, i.e., horizontal impact and rotation of the deadbolt assembly. Although particular embodiments of the invention have been disclosed and described, it should be appreciated that variations will occur to those having ordinary skill in the art. For example, the invention can be utilized with a combination knob operated latch bolt and deadbolt lock assembly, as shown in FIG. 6. In this embodiment, the guard plate 54 includes two openings 56 and 58 for receiving a deadbolt lock assembly 60 and doorknob 62, respectively. In both FIG. 3 and FIG. 6, the guard plates are shown with a double layer over the door edge, which provides somewhat increased strength. It should be noted, however, that a single layer plate could also be utilized. Furthermore, many variations of the tab and slot arrangement disclosed could be developed, including forming a slot in the guard plate and a tab on the housing of the deadbolt lock assembly. It is intended, therefore that the scope of the invention be defined by the appended claims rather than by the particular description given.

We claim:

1. In a door system comprising:

a frame including a lock bolt opening and a doorstop;

a door carried within the frame;

a door lock assembly connected to the door, said assembly including a lock bolt extending from an edge of the door into said lock bolt opening when the door is closed, the improvement comprising:

a one-piece L-shaped guard plate having a first leg which fits over the side of the door opposite said doorstop, said first leg including a first opening through which a portion of the door lock assembly extends, and a second leg which covers a portion of the door edge, said second leg including a second opening through which the lock bolt extends, wherein the side of the door facing the doorstop has a substantially flat surface along the length of the doorstop, whereby said guard plate can be installed in an existing door system without causing misalignment of said lock bolt with respect to said lock bolt opening.

2. The system of claim 1 wherein said door lock includes a lock unit having a housing portion including at least one slot and wherein said guard plate includes at least one integral tab extending into the first opening and engaging said at least one slot, said tab and slot arrangement providing increased resistance to the application of torsional forces to the lock unit.

3. A door system having increased security, comprising:

a frame including a lock bolt opening and a door stop;

a door carried within the frame;

a door lock assembly connected to the door, said assembly including a lock bolt extending from an edge of the door into said lock bolt opening when the door is closed; and a one-piece L-shaped guard plate having a first leg which fits over the side of the door opposite said doorstop, said first leg including a first opening through which a portion of the door lock assembly extends, and a second leg which covers a portion of the door edge, said second leg including a second opening through which the lock bolt extends and wherein said second leg includes an extension which is folded over so that it is generally parallel with the second leg, said extension including a third opening corresponding to the second opening, thereby providing a two layer second leg.

4. The system of claim 1 wherein said first leg includes at least one generally horizontal reinforcing rib.

5. The door system of claim 1 wherein said door lock assembly further includes a latch unit having a knob extending from an additional opening in said first leg.

6. The system of claim 1 wherein said door lock includes a lock unit having a housing portion including at least one integral tab and wherein said guard plate includes at least one slot engaging said at least one tab, said tab and slot arrangement providing increased resistance to the application of torsional forces to the lock unit.

* * * * *